US006619938B2

(12) United States Patent
Woodruff

(10) Patent No.: US 6,619,938 B2
(45) Date of Patent: Sep. 16, 2003

(54) FLEXIBLE VANE PUMP

(76) Inventor: Keith F. Woodruff, 1331 Summit La., Mountainside, NJ (US) 07092

( * ) Notice: Subject to any disclaimer, the term of this patent is extended or adjusted under 35 U.S.C. 154(b) by 0 days.

(21) Appl. No.: 09/866,395

(22) Filed: May 25, 2001

(65) Prior Publication Data

US 2001/0024619 A1 Sep. 27, 2001

Related U.S. Application Data

(63) Continuation-in-part of application No. 09/482,652, filed on Jan. 13, 2000.

(51) Int. Cl.[7] ..... F03C 2/00

(52) U.S. Cl. ..... 418/142; 418/152; 418/156; 418/178; 418/252

(58) Field of Search ..... 418/149, 178, 418/152, 153, 259

(56) References Cited

U.S. PATENT DOCUMENTS

| | | | | | |
|---|---|---|---|---|---|
| 1,426,954 | A | * | 8/1922 | Brooks | 416/240 |
| 2,442,783 | A | * | 6/1948 | Senn | 416/240 |
| 2,455,194 | A | * | 11/1948 | Rumsey | 418/154 |
| 2,766,964 | A | * | 10/1956 | Almquist et al. | 415/141 |
| 2,899,902 | A | * | 8/1959 | Bandli et al. | 418/179 |
| 2,976,811 | A | * | 3/1961 | Sully | 418/142 |
| 3,053,190 | A | * | 9/1962 | Carlson | 418/154 |
| 3,059,584 | A | * | 10/1962 | Cottell | 418/142 |
| 3,164,098 | A | * | 1/1965 | Sully | 418/154 |
| 3,313,239 | A | * | 4/1967 | Brunson et al. | 418/178 |
| 3,552,895 | A | * | 1/1971 | Bayley | 418/179 |
| 3,827,835 | A | * | 8/1974 | Higuchi et al. | 418/178 |
| 3,853,439 | A | * | 12/1974 | Jones | 418/142 |
| 3,853,440 | A | * | 12/1974 | Green | 418/142 |
| 3,886,764 | A | * | 6/1975 | Edwards | 418/225 |
| 4,028,021 | A | * | 6/1977 | Berkowitz | 418/142 |
| 4,032,270 | A | * | 6/1977 | Sheth et al. | 418/238 |
| 4,243,233 | A | * | 1/1981 | Arai | 418/142 |
| 4,276,007 | A | * | 6/1981 | Sakamaki et al. | 418/178 |
| 4,345,886 | A | * | 8/1982 | Nakayama et al. | 418/142 |
| 4,392,779 | A | * | 7/1983 | Bloemers et al. | 418/154 |
| 4,462,755 | A | * | 7/1984 | Ogle et al. | 416/132 R |
| 4,464,101 | A | * | 8/1984 | Shibuya | 418/178 |
| 4,859,162 | A | * | 8/1989 | Cox | 418/178 |
| 4,863,344 | A | * | 9/1989 | Stefanini | 418/153 |
| 5,080,567 | A | * | 1/1992 | White, Jr. | 418/142 |
| 5,449,280 | A | * | 9/1995 | Maki et al. | 418/133 |

FOREIGN PATENT DOCUMENTS

| | | | | |
|---|---|---|---|---|
| AU | 244389 | * | 6/1961 | 418/153 |
| DE | 22163 | * | 5/1917 | 418/178 |
| JP | 58-124081 | * | 7/1983 | 418/156 |

* cited by examiner

*Primary Examiner*—Thomas Denion
*Assistant Examiner*—Theresa Trieu
(74) *Attorney, Agent, or Firm*—Mark P. Stone

(57) ABSTRACT

A pump has a rotor with two or more flexible vanes forming one or more compartments between adjacent vanes. The rotor is mounted offset relative to a rotor sleeve such that the volume of the compartments varies as the rotor rotates in the sleeve. Incoming fluid is supplied to the compartments along a plane perpendicular to the plane of rotation of the vanes. Fluid is discharged from the compartments through discharge slots in the sleeve leading into a discharge outlet which is tangential relative to the plane of rotation of the vanes. Each flexible vane is formed from at least two thin leaf springs separated by a layer of laminate and joined to a shoe which engages the inner surface of the sleeve as the rotor rotates. The pump in accordance with the present invention is energy efficient and uses significantly less power than comparable known devices.

15 Claims, 4 Drawing Sheets

FLEXIBLE VANE PUMP

This application is a continuation-in-part of U.S. patent application Ser. No. 09/482,652, filed Jan. 13, 2000, and entitled "Flexible Vane Pump".

BACKGROUND OF THE INVENTION

The present invention is directed to improvements to pumps, and in particular, pumps having flexible or resilient vanes extending from a rotor for engaging a rotor sleeve as the rotor rotates within the sleeve during operation of the pump.

Known flexible vane pumps exhibit several disadvantages. Among other things, operation of the known devices requires a relatively large input power supply thereby rendering the known devices energy inefficient. Additionally, the arrangement and components of the rotor assembly, and in particular, the flexible vanes of the known devices are subject to wear thereby limiting the useful operating life of the rotor and requiring replacement at a relatively frequent interval.

It is the primary object of the present invention to overcome the disadvantages of the known devices. In accordance with the preferred embodiments of the present invention, a pump is provided which is energy efficient and which has a useful life greater than that of the known flexible vane pumps. Other advantages of the pump will become apparent from the following description thereof, in conjunction with the drawings.

SUMMARY OF THE INVENTION

A flexible vane pump includes a rotor having a central axis and a plurality of flexible or resilient vanes extending radially outwardly from the rotor. The rotor is mounted for rotation within a cylindrical sleeve, and the ends of the flexible vanes engage the inner surface of the sleeve as the rotor rotates. A plurality of compartments are defined between pairs of adjacent flexible vanes, and the central axis of the rotor is offset relative to the central axis of the sleeve so that the volume of the compartments defined between adjacent flexible vanes varies as the rotor rotates within the sleeve. A plurality of fixed vanes also extend outwardly from the rotor and are arranged so that at least one fixed vane extends into each compartment defined between each pair of adjacent flexible vanes. The remote end of each fixed vane terminates before it engages against the inner surface of the sleeve to avoid contact with the sleeve as the rotor rotates. The fixed vanes provide structural support for the ends of the flexible vanes proximate to the central axis of the rotor and also enhance the flow of incoming fluid into the compartments defined between adjacent flexible vanes.

Inlet means for supplying fluid to the rotor assembly are coupled to an inlet end of the rotor sleeve such that incoming fluid flows along a plane which is substantially perpendicular to the plane of rotation of the rotor. In this manner, the compartments defined between the adjacent flexible vanes are quickly and efficiently filled with the incoming fluid. The rotor axis is outwardly tapered in a direction away from the inlet end, and this arrangement also enhances the efficient filling of the compartments with incoming fluid while expending relatively less energy to do so. The fixed vanes extending from the rotor further enhance the quick and efficient loading of the compartment with fluid by propelling incoming fluid rearwardly into each respective compartment so that subsequent incoming fluid is met with less resistance. The fluid inlet means coupled to the inlet end of the rotor sleeve include an inlet slot which permits incoming fluid to be received only at a predetermined area of the rotor sleeve at which the compartments defined between adjacent flexible vanes are contracted into their smallest volume. As the rotor rotates in the sleeve, the rotor compartment expands in volume to thereby create a partial vacuum causing additional fluid to be drawn into the compartment as the compartment continues to rotate across the inlet slot in the fluid inlet means. As each compartment passes the end of the inlet slot, it becomes sealed and begins to contract in volume, as a result of the offset orientation between the rotor axis and the sleeve, as the sealed compartment rotates towards an outlet means. The inner surface of the sleeve defines at least one slot in communication with the outlet means which is oriented tangentially to the direction of rotation of the rotor. The interaction between the contracted sealed compartment, the discharge slot defined in the inner surface of the sleeve, and the tangential outlet opening in communication with the slot, results in the efficient discharge of fluid from the compressed sealed compartment as it rotates across the tangential discharge means. The compartment now continues to rotate in a direction towards the inlet means where it is again filled with incoming fluid and the cycle repeats. The structural arrangement and cooperation of structure of the rotor, the sleeve, and the inlet and outlet means results in efficient loading and unloading of fluid, thereby decreasing the energy required to operate the pump.

In a further aspect of the invention, the sleeve received in the rotor housing has a greater width than the width of the rotor housing. Preferably, the sleeve is formed from metal, and the rotor housing is formed from plastic. By providing the metallic sleeve with a width greater than that of the plastic rotor housing, the sleeve will overcome and compensate for any deformities or variations in the dimension of the plastic rotor housing which might occur during fabrication of the plastic housing by molding operations.

Removable annular retaining rings on one or both lateral sides of the rotor permit individual vanes to be removed from the rotor for inspection, repair, or replacement. In this manner, individual vanes can be removed and replaced without replacing the entire rotor.

The annular retaining rings can be dimensioned to provide a space between the lateral sides of the rotor and side plates of the rotor housing. In this manner, direct contact between the lateral sides of the vanes of the rotor and the side plates of the rotor housing is avoided.

In a further aspect of the invention, the flexible vanes of the rotor are formed from separate components joined together which include at least two leaf springs and at least one laminate surface separating the leaf springs. Each vane also has a shoe element joined to the leaf springs and the laminate and oriented so that the outer surface of the remote end of the shoe engages the inner surface of the rotor sleeve when the rotor rotates within the sleeve. The use of flexible vanes comprising a plurality of leaf springs, preferably of different lengths, joined together and separated by a layer of laminate, reduces stress and wear that would otherwise occur if each vane were formed from a single thicker spring. Accordingly, the flexible vanes in accordance with the present invention extend the useful operating life of the rotor, and reduce the frequency of rotor replacement.

In a further aspect of the invention, the tip of the outer laminate layer forming the vane is folded over the next inner spring to assure that there is no direct contact between the metallic spring and the inner surface of the metallic rotor sleeve when the rotor rotates within the sleeve. In this manner, metal to metal contact is avoided, thereby increasing the efficiency of the pump and reducing wear on the metallic components.

The cooperating structure and arrangement of components of the device in accordance with the present invention results in a flexible vane pump which requires less energy to operate than comparable conventional pumps, and which has a useful operating life exceeding that of conventional pumps.

DESCRIPTION OF THE BEST MODES FOR CARRYING OUT THE INVENTION

FIGS. 1–4 illustrate a flexible vane pump in accordance with the preferred embodiment of the present invention.

Figure 1:
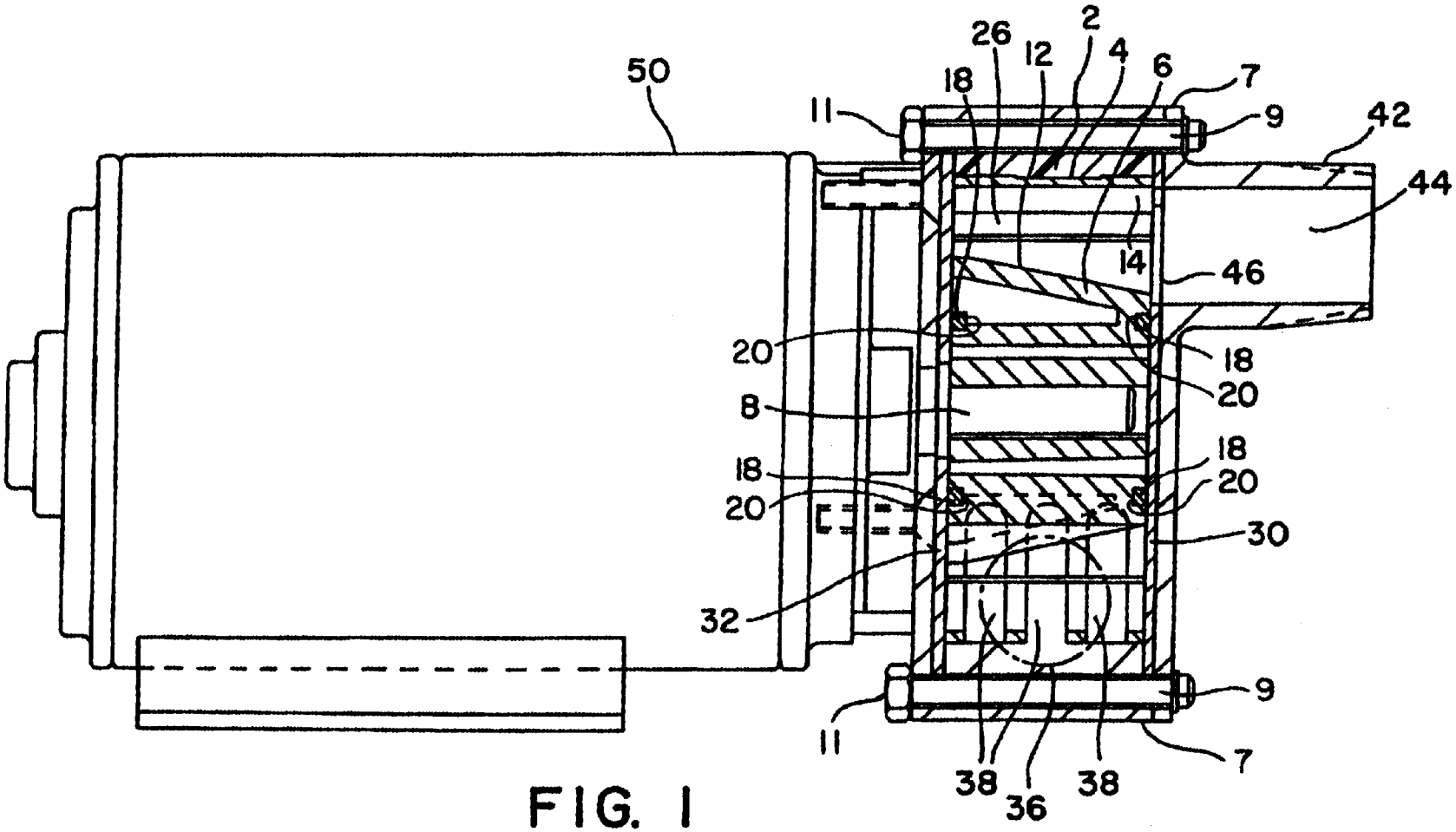
FIG. 1 is a side elevational view, in section, of a pump in accordance with the present invention.
Figure 2:
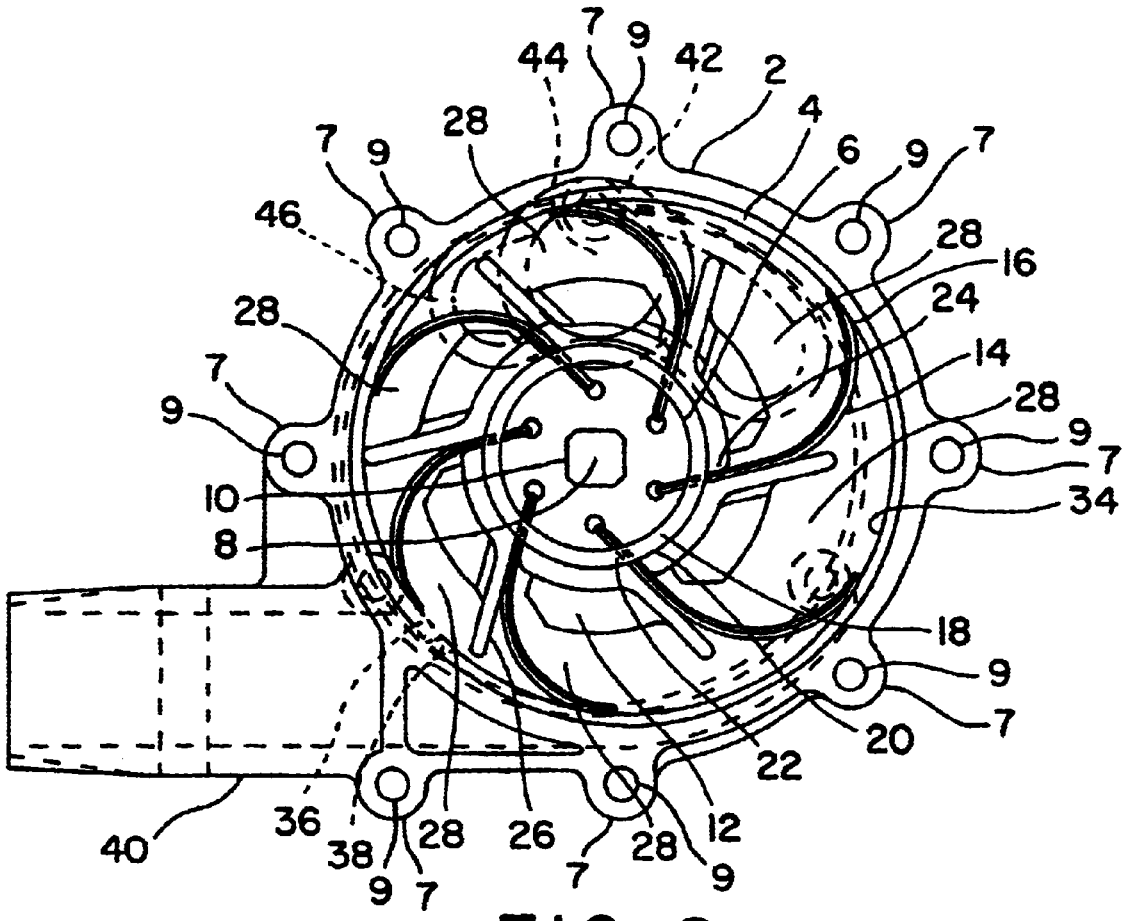
FIG. 2 is a front elevational view, in section, of the pump illustrated in FIG. 1.

Referring to FIGS. 1 and 2, a pump housing is designated by reference numeral 2, and a generally cylindrical sleeve designated by reference numeral 4 is inserted into the pump housing. A rotor, which is generally designated by reference numeral 6, is located within the sleeve 4. The central axis of the rotor, designated by drive shaft 8 received within square drive hole 10, is offset from the central axis of the rotor sleeve 4. As best illustrated by FIG. 1, the outer surface of the rotor 6, generally designated by reference numeral 12, is tapered outwardly in a direction away from the front (inlet) surface of the rotor to define an upwardly inclined outer surface on the rotor 6.

As best illustrated by FIG. 2, a plurality of flexible or resilient vanes, designated by reference numeral 14, extend radially outwardly from the rotor 6. The flexible vanes 14 are arranged relative to the rotor such that the remote ends of each flexible vane, designated by reference numeral 16, engage the inner surface of the rotor sleeve 4 as the rotor 6 rotates in the sleeve. Each flexible vane 14 is mounted to the rotor 6 by a retaining ring 18 received in an annular groove 20 defined in the outer periphery of the rotor 6. Notches 22 and slots 24 in the retaining ring 18 are provided to receive the proximal end of each flexible vane 14 for mounting the flexible vanes 14 to the rotor 6.

As illustrated by FIGS. 1 and 2, a plurality of spacer sleeves 7, each having openings 9, are defined around the outer periphery of the rotor housing 2. Each spacer sleeve 7 is adapted to removably receive a screw 11 for removably mounting front and rear plates 30 and 32 to the rotor housing 2 to assemble the pump. The spacer sleeves 7 prevent over-tightening of the screws 11 which would cause the rotor housing 2 to bow.

As also best illustrated by FIG. 2, a plurality of fixed vanes, designated by reference numeral 26, extend radially outwardly from the outer periphery of the rotor 6. Each of the fixed vanes 26 can be formed integrally with the rotor 6. The fixed vanes 26 provide support for the inner ends of respective adjacent flexible vanes 14. Additionally, as will be discussed herein, the rotating fixed vanes enhance the flow of fluid into the rotor from fluid inlet means coupled to the pump housing.

FIG. 2 also discloses that a plurality of compartments 28 are defined between adjacent flexible vanes 14. The remote ends of each of the flexible vanes 14 engage the inner surface 34 of the rotor sleeve 4 so that each of the compartments 28 is sealed. One of the fixed vanes 26 extends into each of the compartments 28. However, since the remote end of each fixed vane terminates before it engages the inner surface 34 of the rotor sleeve 4, fluid received in each of the compartments 28 can flow around the fixed vane 26 extending into the compartment. As will be discussed in great detail below, the volume of each of the compartments 28 varies as the rotor 6 rotates in the rotor sleeve 4 as a result of the offset orientation of the central axis of the rotor relative to the central axis of the rotor sleeve.

As best illustrated by FIG. 1, a front plate 30 is disposed over the front end of the rotor sleeve 4, and a rear plate 32 is disposed over the rear end of the rotor sleeve 4. The opposed lateral sides of the housing sleeve 4 abut, respectively, against the front and rear plates 30 and 32. The front and rear plates 30 and 32 are arranged to enclose the rotor 6 mounted within the rotor sleeve 4, as best illustrated by FIG. 2. As also shown by FIG. 2, the rotor 6 is mounted within the rotor sleeve 4 such that the central axis of the rotor is offset from the central axis of the rotor sleeve in which the rotor is mounted.

Still referring to FIG. 1, one of the retaining rings 18 is removably mounted in an annular groove 20 in a rear lateral surface of the rotor 6, while a second retaining ring 18 is removably mounted in an annular groove 20 in an opposed front lateral surface of the rotor 6. The plurality of flexible vanes 14 are each individually removably mounted in slots in the rotor 6, and retained therein by the retaining rings 18. Each individual flexible vane 14 is removable from the rotor for inspection, repair or replacement by removing one or both of the retaining rings 18 from the rotor 6, and thereafter removing the flexible vane 14 from the rotor. Accordingly, defective or worn flexible vanes 14 are individually replaceable as needed, without replacing the entire rotor 6.

As illustrated by both FIGS. 1 and 2, a portion of the rotor sleeve 4 defines an outlet or discharge opening designated by reference numeral 36. At least one slot 38 is defined in the inner surface 34 of the rotor sleeve proximate to the outlet opening 36. As will be discussed further herein, the slots 38 feed fluid into the outlet opening 36 as a result of the action of the flexible vanes 14 when the rotor 6 rotates within the rotor sleeve. Discharge means, illustrated by discharge tube 40, is coupled in fluid flow relationship to the discharge opening 36 for receiving fluid discharges from the rotor sleeve during operation of the pump. As best shown by FIG. 2, the outlet opening 36 and the outlet tube 40 are in a substantially tangential orientation relative to the inner surface 34 of the rotor sleeve 4, and are also tangential to the slots 38 in the rotor sleeve which lead into the discharge outlet 36. In this manner, the discharge of material from the rotor sleeve is facilitated by the centrifugal forces of the rotating rotor acting on the discharged material to reduce the overall energy consumption required for operation of the pump.

As best illustrated by FIG. 1, a fluid inlet tube designated by reference numeral 42, defining a fluid inlet channel 44, is coupled in fluid flow relationship to the front (inlet) end of the rotor sleeve 4 of the pump housing 2. In this manner, the flow of fluid into the pump housing and rotor sleeve is along a plane which is oriented substantially perpendicular to the plane along which the rotor 6 rotates. The perpendicular orientation between the incoming fluid flow and the plane of rotation of the rotor results in energy efficient inlet flow of fluid into the pump housing and the rotor sleeve, thereby reducing the overall power consumption necessary to operate the pump.

Figure 4:
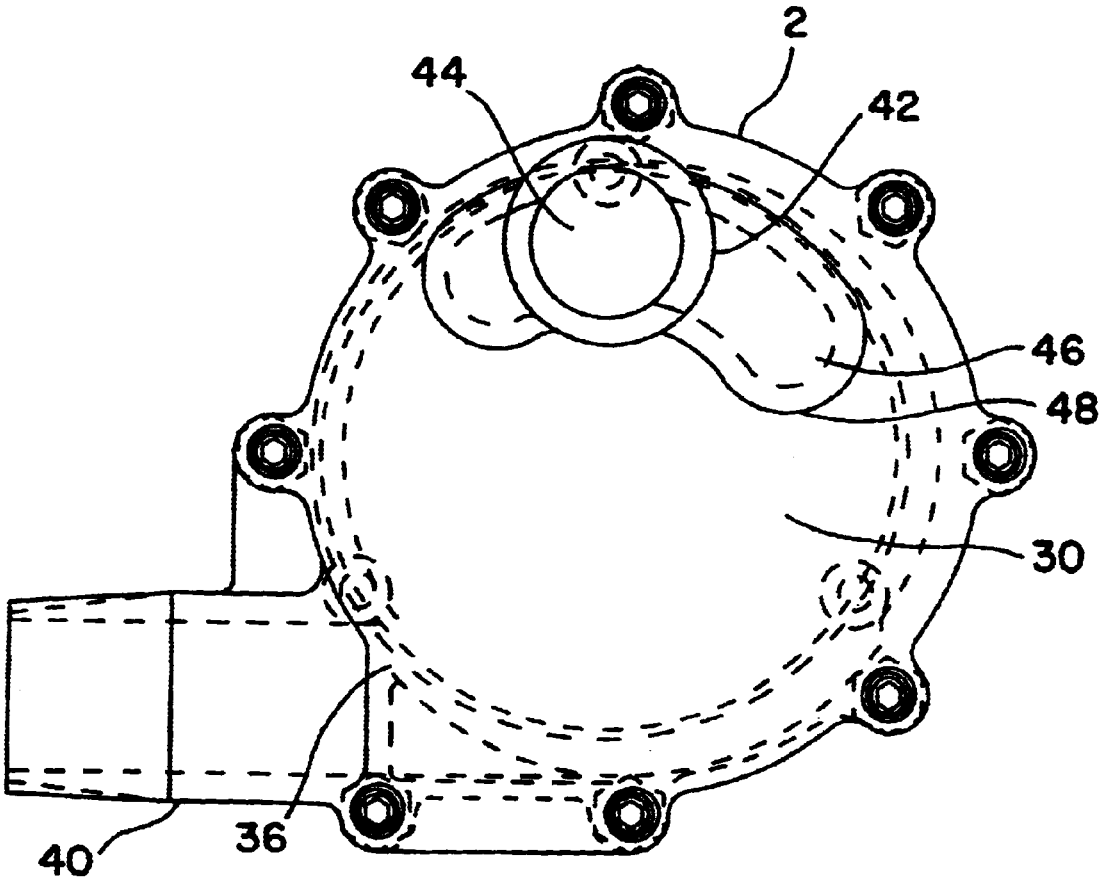
FIG. 4 is a front elevational view of the pump as illustrated by FIG. 2 in which a slotted inlet plate is shown disposed over the inlet end of the rotor sleeve.

As illustrated by FIGS. 1 and 2, and as best shown by FIG. 4, the front end plate 30 mounted over the inlet end of the rotor sleeve 4, defines an arcuate inlet slot designated by reference numeral 46. The discharge end of the inlet tube 42 is in fluid communication with the inlet slot 46 so that all fluid flowing from the inlet tube 42 into the inlet end of the rotor sleeve 4 must pass through the inlet slot 46. The relative arrangement of the inlet tube 42 and the inlet slot 46 controls the position at which incoming fluid first enters the rotor sleeve. As also shown by FIG. 4, the inlet end of the tube 42 abutting against the inlet slot 46 in the end plate 30, is itself mounted on a support plate which defines an arcuate recess 48 in substantial registration with the arcuate inlet slot 46. In this manner, inlet fluid flowing from the pipe 42 is more evenly distributed along the inlet slot 46 by the arcuate recess 48 so that the incoming fluid flows uniformly from the pipe 42 and into the rotor sleeve 4.

As shown by FIG. 1, a power source, such as an electric motor designated by reference numeral 50, is coupled to the rotor square drive shaft 8 for rotating the rotor 6 when the pump is in operation.

Figure 3:
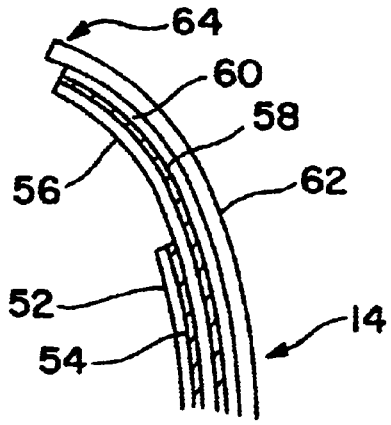
FIG. 3 illustrates, in section, a flexible vane in accordance with the present invention.

FIG. 3 illustrates, in detail, one of the plurality of flexible vanes 14 extending radially outwardly from the rotor 6, as best illustrated by FIG. 2. The flexible vane 14 is formed from a first inner leaf spring designated by reference numeral 52, and a plastic laminate 54 bonded to the outer surface of the spring 52. A second spring 56, which is longer in length than spring 52 and laminate 54, is mounted to the outer surface of the laminate 54. A second layer of plastic laminate, designated by reference numeral 58, is bonded to the outer surface of the spring 56, and a third spring 60, of the same length as spring 56, is mounted to the outer surface of the laminate layer 58. A shoe 62, longer in length than springs 56 and 60 and laminate layer 58, is mounted to the outer surface of spring 60. The outer surface of the remote end 64 of the shoe 62 is biased by springs 52, 56 and 60 to engage and directly contact the inner surface 34 of the rotor sleeve 4 when the rotor 6 is mounted in the rotor sleeve, as illustrated by FIG. 2. Preferably, the springs 52, 56 and 60 are stainless steel leaf springs, and the shoe 62 is formed from a high molecular weight polyethylene. The use of a plurality of different springs, some of which are of differing lengths, reduce stress and wear that would otherwise occur if the vane were formed from a single piece spring. Additionally, use of a plurality of different spring components provides backup in the event that one of the spring components fails. Accordingly, forming the flexible vane 14 from at least two separate spring components reduces stress and wear on the vane, thereby reducing the frequency of repair and replacement of the rotor and increasing its useful operating life.

As illustrated by FIG. 3, the outer layer of the flexible vane 14 is provided by a shoe 62 which is formed from polyurethane. In this manner, a non-metallic material engages the inner metallic surface of the rotor sleeve 4 as the rotor and vanes rotate within the pump housing. Elimination of metal to metal contact increases the efficiency of the pump, and decreases wear of the metallic components. In accordance with the present invention, the front tip of the shoe 62 can be folded over the front end of the vane to further reduce the possibility of metal to metal contact between the metallic spring components of the vane 14 as the vane 14 rotates with its forward free end in engagement with the inner metallic surface of the rotor housing sleeve.

In operation of the pump disclosed by FIGS. 1–4, incoming fluid, particularly liquid, is supplied through the inlet channel 44 of the inlet tube 42. The incoming fluid flows through the arcuate inlet slot 46 defined in the front end plate 30 disposed over the front (inlet) surface of the rotor sleeve 4 along a plane substantially perpendicular to the plane of rotation of the rotor. The rotor 6 has a central axis which is offset relative to the central axis of the rotor sleeve 4 such that the volume of the compartments 28, defined between adjacent flexible vanes 14, varies as the rotor 6 rotates in a predetermined direction of rotation in the rotor sleeve 4. The inlet slot 46 is arranged to introduce fluid into the rotor sleeve at a position therein in which the compartments 28 are at their smallest volume. Once fluid is initially introduced into a compartment in registration with the inlet slot 46, the compartment expands in volume as the rotor rotates from the leading end towards the trailing end of the slot 46 (i.e., in a clockwise direction as shown in FIG. 2.). As the expanding compartment 28 moves along the inlet slot 46, a partial vacuum is created in the compartment to draw additional material into the compartment. The suction created by the partial vacuum reduces the energy consumption by the pump necessary to draw incoming fluid into the rotor sleeve. Additionally, the fixed vanes 26 extending into each compartment 28 enhance the flow of fluid into the compartment, as does the upwardly inclined outer surface 12 of the rotor 6 in a direction away from the front (inlet) surface of the rotor. The cooperation between the partial vacuum created by the expanding chambers 28, the action of the fixed vane 26, and the inclined outer surface of the rotor 6, reduce the electrical energy requirement needed to draw fluid from the inlet tube 42 into the rotor sleeve 4 as the rotor rotates in the sleeve. The energy efficient operation of the pump is further enhanced as a result of the substantially perpendicular orientation of the direction of flow of incoming fluid through the inlet tube 42 and the plane of rotation of the rotor 4. Loading inflowing fluid into the compartments 28 defined between the flexible vanes 14 of the rotor in a perpendicular, not tangential, orientation, reduces the energy input required to fully load the compartments 28 with the incoming fluid by reducing obstruction to incoming fluid by the rotating vanes.

Still referring to FIG. 2 of the drawing, after a compartment 28 has been loaded with fluid and the trailing flexible vane 14 has rotated past the trailing edge of the inlet slot 46 (e.g., the right end of slot 46 in FIG. 2 when the rotor rotates in a clockwise direction), the compartment 28 becomes completely sealed by the opposed flexible vanes 14, the inner surface 34 of the rotor sleeve 4, the front wear plate 30, and the rear wear plate 32. As a result of the offset orientation between the rotor and the rotor sleeve, as the rotor continues to rotate (in a clockwise direction shown by FIG. 2), each compartment 28 reaches a maximum volume, and thereafter begins to contract in volume as the compartment approaches the outlet opening 36 in the rotor sleeve 4. The compressive forces applied to the fluid in the sealed compartment as the compartment continues to contract in volume supplements the energy required to efficiently discharge the fluid from the compartment, thereby further reducing the overall energy consumption necessary for the operation of the pump. Slots 38, defined in the inner surface 34 of the sleeve immediately prior to the discharge outlet 36 (when the rotor rotates in a clockwise direction as shown by FIG. 2) assist in uniformly and efficiently discharging fluid from each compartment 28 as the compartment rotates over the discharge outlet opening 36. The tangential orientation between the discharge opening 36 and the slots 38 relative to the inner surface 34 of the rotor sleeve 4 increases the efficiency of the discharge of fluid from the sleeve. The fluid discharged through the outlet opening 36 is received within a discharge tube 40 coupled in fluid communication to the discharge opening 36. Any small quantity of material not discharged from a compartment 28 through the discharge opening 36 tends to ride along the inner surface 34 of the rotor sleeve 4 as the rotor continues to rotate, thereby enhancing the seal between the compartment 28 and the rotor sleeve 4.

As the compartment 28 passes over the discharge outlet 36, the volume of the compartment continues to contract as a result of the offset relationship between the rotor and the rotor sleeve. The contraction of the compartment continues until the compartment approaches the leading edge of the inlet arcuate slot 46 (the leftmost end of the slot 46 as shown in FIG. 2 when the rotor rotates in a clockwise direction), at which point the volume of the chamber 28 is at its minimum. As the chamber continues to rotate across the inlet slot 46, it is again loaded with incoming fluid and the operating cycle described above is repeated.

A pump in accordance with the invention described herein requires less electrical energy for operation than that of comparable devices. The reduced energy requirement results from one or more from the several different structural and functional features described herein including the orientation of incoming fluid along a plane perpendicular to the plane of rotation of the rotor, the offset relationship between the rotor and rotor sleeve resulting in compartments of variable volume as the compartments rotate across an arcuate inlet loading slot, the outwardly increasing sidewall of the rotor in a direction away from the inlet end, and the slots defined in the rotor sleeve positioned forward of an outlet discharge opening oriented tangentially relative to the inner surface of the rotor sleeve for uniformly discharging fluid from the rotor sleeve. A pump in accordance with the present invention also has a useful operating life exceeding that of comparable devices as a result of the employment of flexible vanes formed from more than a single spring component.

The pump in accordance with the present invention also includes means for preventing damage from fluid pressure exceeding a predetermined operating level. In the event that the fluid pressure in each of the compartments 28 exceeds a predetermined operating level, the excess pressure will cause the free ends 16 of the flexible vanes 14 to disengage from the inner surface 34 of the rotor sleeve 4. When this occurs, the compartments 28 are no longer sealed and fluid will no longer be forced from the compartments through the discharge outlet 36 as the rotor continues to rotate in the rotor sleeve. Once the fluid pressure in the compartments 28 is decreased below the predetermined operating level, the resilient bias on the flexible vanes 14 overcomes the fluid pressure acting on the flexible vanes, and the free ends 16 of the vanes 14 re-engage against the inner surface 34 of the rotor sleeve 4. When this occurs, the compartments 28 are again sealed, fluid in the compartments is discharged as the compartments rotate over the discharge outlet 36, and the pumping operation is resumed. The predetermined fluid pressure which causes the pump to cease operation is controlled by the resilient characteristic of the flexible vanes 14 and therefore can be adjusted by replacing the rotor with a different rotor having vanes of a different resilient characteristic.

In the preferred embodiments of the invention, the resilient elements of the flexible vanes are leaf springs, preferably formed from stainless steel, and the shoe element of the flexible vane is preferably formed from a plastic material, and in particular, polypropylene or an ultra high molecular weight polyethylene. Preferably the rotor, the fixed vanes of the rotor, and the rotor housing are formed from a durable plastic material. The cylindrical sleeve within the rotor housing, and the front and rear end plates disposed over the front and rear ends of the rotor sleeve, preferably are formed from a metallic material, such as stainless steel, but may also be formed from a ceramic material for special operations (such as when fluid flowing through the pump comprises an abrasive material).

Figure 5:
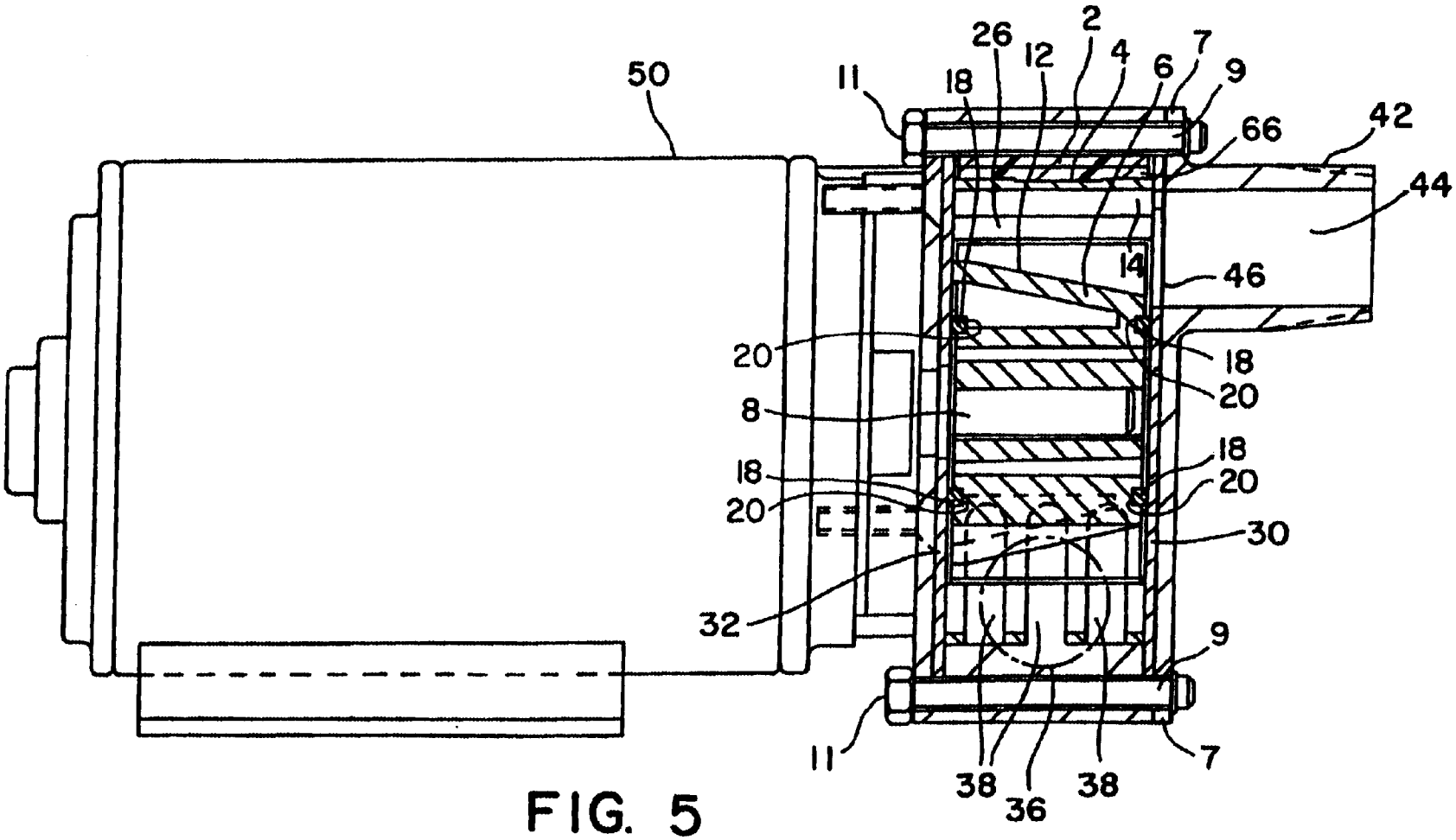
FIG. 5 is a side elevational view, in section, of a modification to the pump illustrated in FIG. 1.

FIG. 5 illustrates a modification of the pump illustrated by FIG. 1. The same reference numerals are used in FIGS. 1 and 5 to designate common elements. Except as specifically discussed with respect to FIG. 5, the structure and operation of the pump illustrated by FIG. 5 is identical in structure and operation to the pump illustrated and discussed with respect to FIGS. 1–4.

In the FIG. 5 embodiment of the pump, the width of the metallic rotor sleeve 4 is greater than the width of the rotor housing 2. As seen in the drawing, the lateral ends of the sleeve 4 extend beyond the lateral ends of the housing 2 when the sleeve is received in its operating position within the housing. The lateral extension of the sleeve beyond the housing compensates for any deformities or variations in the radial dimension of the housing which may have occurred during fabrication of the housing. As noted above, in the preferred embodiments of the invention, the housing is formed from a molded plastic material.

Additionally, as seen in FIG. 5, the rotor sleeve 4 extends laterally beyond the opposed lateral sides of the rotor 6 to create a space between the lateral sides of the flexible vanes 14 and the front and rear walls 30 and 32, respectively. This spacing tends to prevent direct contact between the lateral sides of the vanes 14 and the walls 30 and 32 during rotation of the rotor, thereby increasing the efficiency of the pump and decreasing the wear on the rotor, vanes and sidewalls 30 and 32.

Still referring to FIG. 5, the opposed retaining rings 18 received in the grooves 20 defined on the opposed lateral sides of the rotor 6 extend beyond the lateral sides of the rotor. The retaining rings 18 therefore provide lateral spacer elements separating the lateral sides of the rotor 6 from the front and rear walls 30 and 32 of the rotor housing assembly. The spacing provided by the retaining rings 18 corresponds to the spacing provided by the lateral extension of the rotor sleeve to provide the same spacing between the rotor and the front and rear walls 30 and 32 as the spacing between the rotor housing 2 and the front and rear walls 30 and 32 provided by the lateral extension of the rotor sleeve 4, as discussed above. Accordingly, the spacing provided by the retaining rings 18 corresponds to and supplements the spacing provided by the lateral extension of the rotor sleeve 4. In this manner, direct contact between either of the lateral sides of the flexible vanes 14, the lateral sides of the fixed vanes 26, or the lateral sides of the rotor 6, and the front and rear walls 30 and 32 is avoided when the rotor rotates within the rotor housing, thereby increasing the efficiency of the pump and reducing wear on the components.

It is apparent that the retaining rings 18 perform multiple functions in the pump illustrated by FIG. 5. The retaining rings permit the selective removal of individual flexible vanes 14 from the rotor as previously discussed herein, and the retaining rings further provide lateral spacing elements as discused above.

The pump illustrated by FIG. 5 also includes a seal element, preferably an O-ring, designated by reference numeral 66. The O-ring 66 is disposed between the rotor housing 2 and the rotor sleeve 4. The O-ring is provided to prevent leakage of fluid from the pump in the event of damage to the rotor sleeve 4, the rotor housing 2, or both.

Other variations and modifications of the invention disclosed herein will become apparent to those skilled in the art. Accordingly, the description of the preferred embodiments are intended to be illustrative only, but not restrictive of the scope of the invention, that scope being defined by the following claims and all equivalents thereto.

What is claimed is:

1. A pump comprising:

a rotor housing;

a rotor mounted in said rotor housing for rotation therein along a predetermined plane of rotation;

front and rear walls mounted, respectively, to front and rear sides of the rotor housing;

said rotor including at least one vane mounted thereon and rotated therewith;

means for removing said at least one vane from said rotor;

wherein said means for removing includes at least one retaining element removably mounted to said rotor for retaining said at least one vane in said rotor;

said retaining element comprising a ring;

said rotor defining at least one complete groove on a lateral side of said rotor, said ring being removably received in said at least one complete groove.

2. The pump as claimed in claim 1 wherein said rotor sleeve is continuous and is removably received within said rotor housing.

3. The pump as claimed in claim 1 wherein said rotor sleeve extends beyond at least one lateral side of said rotor housing to provide a space between said at least one lateral side of said rotor housing and one of said front and rear walls of said rotor housing.

4. The pump as claimed in claim 3 wherein said rotor sleeve extends laterally beyond both lateral sides of said rotor housing to provide spacing between each of said lateral sides of said rotor housing and both said front and rear walls of said rotor housing.

5. The pump as claimed in claim 1 wherein said rotor sleeve is metallic.

6. The pump as claimed in claim 1 wherein said rotor housing is plastic.

7. The pump as claimed in claim 1 further including a seal disposed between said rotor housing and said rotor sleeve.

8. The pump as claimed in claim 7 wherein said seal comprises an O-ring.

9. The pump as claimed in claim 1 further including at least one spacer sleeve defined on the periphery of said rotor housing and adapted to prevent overtensioning of a fastening element received in said at least one spacer sleeve.

10. The pump as claimed in claim 9 further including a plurality of spacer sleeves defined along the periphery of said rotor housing.

11. The pump as claimed in claim 1 further including a plurality of vanes mounted to said rotor, and means for individually removing each of said plurality of vanes from said rotor.

12. The pump as claimed in claim 1 wherein said rotor defines two lateral sides, each of said lateral sides defining a complete groove, and one said ring removably received in each said complete groove.

13. A pump comprising:

a rotor housing having a front wall and a rear wall mounted thereto;

a rotor mounted in said rotor housing for rotation therein along a predetermined plane of rotation;

a spacer element extending from at least one lateral side of said rotor to provide a space between said at least one lateral side of said rotor and one of said front and rear walls of said rotor housing;

said rotor having at least one vane mounted thereto for rotation therewith, said spacer element comprising means for removing said at least one vane from said rotor;

wherein a complete groove is defined on said at least one lateral side of said rotor, and said spacer element is a ring removably receivable in said complete groove defined in said at least one lateral side of said rotor.

14. The pump as claimed in claim 13 wherein said rotor has two opposed lateral sides each defining one said complete groove, and one of said spacer elements extending from one said complete groove defined in each of said lateral sides of said rotor.

15. The pump as claimed in claim 13 wherein said rotor has a plurality of vanes mounted thereto for rotation therewith, and said spacer element comprises means for individually removing each of said plurality of vanes from said rotor.

* * * * *